US008167715B2

(12) United States Patent
Lesley et al.

(10) Patent No.: US 8,167,715 B2
(45) Date of Patent: May 1, 2012

(54) ADJUSTABLE PLAYING AREA FOR ELECTRONIC GAMING TERMINAL

(75) Inventors: Paul M. Lesley, Blue Island, IL (US); Joel R. Jaffe, Glenview, IL (US); Jacob C. Greenberg, Elgin, IL (US); Norm Wurz, Des Plaines, IL (US); Bruce Urban, Lisle, IL (US); Walter E. Smolucha, Melrose Park, IL (US)

(73) Assignee: WMS Gaming Inc., Waukegan, IL (US)

( * ) Notice: Subject to any disclaimer, the term of this patent is extended or adjusted under 35 U.S.C. 154(b) by 285 days.

(21) Appl. No.: 12/612,753

(22) Filed: Nov. 5, 2009

(65) Prior Publication Data

US 2010/0120530 A1 May 13, 2010

Related U.S. Application Data

(60) Provisional application No. 61/112,967, filed on Nov. 10, 2008.

(51) Int. Cl.
*A63F 9/24* (2006.01)

(52) U.S. Cl. ..... 463/30; 463/31

(58) Field of Classification Search ..... 463/30, 463/31

See application file for complete search history.

(56) References Cited

U.S. PATENT DOCUMENTS

| | | | | |
|---|---|---|---|---|
| 2,661,954 | A | 12/1953 | Koci | 463/57 |
| D236,720 | S | 9/1975 | Baker | D21/370 |
| 4,046,419 | A | 9/1977 | Schmitt | 297/153 |
| D264,485 | S | 5/1982 | Kitchen | D21/370 |
| 4,705,274 | A | 11/1987 | Lubeck | 273/148 |
| 4,840,343 | A | 6/1989 | Gasser | 248/500 |
| 4,960,117 | A | 10/1990 | Moncrief et al. | 463/46 |
| D315,110 | S | 3/1991 | Slater | D10/88 |
| 5,015,189 | A | 5/1991 | Wenzinger et al. | 434/63 |
| 5,083,738 | A | 1/1992 | Infanti | 248/500 |
| 5,102,192 | A | 4/1992 | Barile | 297/257 |
| 5,114,112 | A | 5/1992 | Infanti | 248/500 |

(Continued)

FOREIGN PATENT DOCUMENTS

DE 4211311 A1 4/1992

(Continued)

OTHER PUBLICATIONS

Product Sheet for "American Eagle", Eagle Co. Ltd., 2 pages, (1997).

(Continued)

*Primary Examiner* — Pierre E Elisca
(74) *Attorney, Agent, or Firm* — Nixon Peabody LLP

(57) ABSTRACT

A gaming terminal includes a gaming cabinet, at least one display, an adjustable playing area, and a player-input button. The at least one display is mounted to the gaming cabinet and configured to display a randomly selected outcome from a wagering game. The randomly selected outcome is selected from a plurality of outcomes in response to receiving a wager input from a player. The adjustable playing area is mounted to the gaming cabinet below the at least one display. The adjustable playing area is operable to translate linearly between a proximal position and a distal position, the proximal position being near the gaming cabinet and the distal position being away from the gaming cabinet. The player-input button is mounted in the adjustable playing area for receiving game play input from the player.

26 Claims, 6 Drawing Sheets

U.S. PATENT DOCUMENTS

| | | | | |
|---|---|---|---|---|
| 5,127,651 | A | 7/1992 | Okada | 273/143 |
| 5,143,055 | A | 9/1992 | Eakin | 601/47 |
| D333,164 | S | 2/1993 | Kraft et al. | D21/325 |
| 5,195,746 | A | 3/1993 | Boyd et al. | 463/37 |
| 5,232,191 | A | 8/1993 | Infanti | 248/500 |
| 5,290,034 | A | 3/1994 | HIneman | 273/148 |
| D351,869 | S | 10/1994 | Rothschild et al. | D21/37 |
| 5,409,296 | A | 4/1995 | Barlie | 297/344.1 |
| 5,411,257 | A | 5/1995 | Fulton | 273/85 |
| 5,437,453 | A | 8/1995 | Hineman | 273/148 |
| 5,472,197 | A | 12/1995 | Gwiasda et al. | 273/143 R |
| 5,522,641 | A | 6/1996 | Infanti | 297/344.13 |
| 5,537,290 | A | 7/1996 | Brown et al. | 361/681 |
| 5,542,748 | A | 8/1996 | Barlie | 297/463.1 |
| D376,391 | S | 12/1996 | Okumura | D21/326 |
| 5,603,659 | A | 2/1997 | Okada | 463/25 |
| D380,014 | S | 6/1997 | Yang | D21/370 |
| 5,669,818 | A | 9/1997 | Thorner et al. | 463/30 |
| 5,678,886 | A | 10/1997 | Infanti | 297/217.3 |
| 5,762,617 | A | 6/1998 | Infanti | 601/49 |
| 5,765,797 | A | 6/1998 | Greene et al. | 248/398 |
| 5,791,731 | A | 8/1998 | Infanti | 297/217.3 |
| 5,820,460 | A | 10/1998 | Fulton | 463/13 |
| D407,759 | S | 4/1999 | Isetani et al. | D21/326 |
| 5,984,782 | A | 11/1999 | Inoue | 463/20 |
| D419,201 | S | 1/2000 | De Haas | D21/370 |
| D419,606 | S | 1/2000 | Toriyama | D21/325 |
| 6,047,963 | A | 4/2000 | Pierce et al. | 273/143 R |
| D424,122 | S | 5/2000 | Dickenson et al. | D21/325 |
| D428,062 | S | 7/2000 | Hayashi | D21/325 |
| 6,089,663 | A | 7/2000 | Hill | 297/258.1 |
| 6,102,394 | A | 8/2000 | Wurz et al. | 273/138.2 |
| 6,117,010 | A | 9/2000 | Cantebury | 463/20 |
| 6,129,355 | A | 10/2000 | Hahn et al. | 273/142 R |
| 6,134,103 | A | 10/2000 | Ghanma | 361/681 |
| 6,135,562 | A | 10/2000 | Infanti | 297/440.2 |
| 6,155,925 | A | 12/2000 | Giobbi et al. | 463/20 |
| 6,159,098 | A | 12/2000 | Slomiany et al. | 463/25 |
| D439,931 | S | 4/2001 | Yamaguchi | D21/369 |
| 6,210,279 | B1 | 4/2001 | Dickinson | 463/37 |
| 6,224,482 | B1 | 5/2001 | Bennett | 463/20 |
| 6,227,614 | B1 | 5/2001 | Rubin | 297/172 |
| 6,227,970 | B1 | 5/2001 | Shimizu et al. | 463/20 |
| D443,313 | S | 6/2001 | Brettschneider | D21/369 |
| D446,252 | S | 8/2001 | Yamaguchi | D21/325 |
| 6,283,546 | B1 | 9/2001 | Hill | 297/271.1 |
| 6,290,229 | B1 | 9/2001 | Perez | 273/148 |
| D450,094 | S | 11/2001 | Hedrick et al. | D21/369 |
| 6,315,666 | B1 | 11/2001 | Mastera et al. | 463/31 |
| 6,334,612 | B1 | 1/2002 | Wurz et al. | 273/143 R |
| 6,354,660 | B1 | 3/2002 | Friedrich | 297/217.1 |
| D459,402 | S | 6/2002 | Wurz et al. | D21/325 |
| 6,422,670 | B1 | 7/2002 | Hedrick et al. | 312/223.1 |
| 6,422,941 | B1 | 7/2002 | Thorner et al. | 463/30 |
| 6,439,993 | B1 | 8/2002 | O'Halloran | 463/16 |
| D463,504 | S | 9/2002 | Stephen | D21/325 |
| D464,377 | S | 10/2002 | Wurz et al. | D21/325 |
| D466,160 | S | 11/2002 | Hirato et al. | D21/325 |
| D467,977 | S | 12/2002 | Gatto et al. | D21/326 |
| D468,364 | S | 1/2003 | Beadell et al. | D21/325 |
| 6,530,842 | B1 | 3/2003 | Wells et al. | 463/46 |
| 6,530,872 | B2 | 3/2003 | Freshland et al. | 494/49 |
| 6,572,187 | B2 | 6/2003 | Laufer | 297/217.1 |
| 6,589,114 | B2 | 7/2003 | Rose | 463/20 |
| 6,609,972 | B2 | 8/2003 | Seelig | 463/20 |
| 6,616,142 | B2 | 9/2003 | Adams | 273/292 |
| 6,646,695 | B1 | 11/2003 | Gauselmann | 349/58 |
| D483,075 | S | 12/2003 | Kang | D21/326 |
| 6,702,409 | B2 | 3/2004 | Hedrick et al. | 312/223 |
| 6,715,756 | B2 | 4/2004 | Inoue | 273/138 |
| D492,363 | S | 6/2004 | Seelig et al. | D21/370 |
| D492,364 | S | 6/2004 | Seelig et al. | D21/370 |
| D492,676 | S | 7/2004 | Monson et al. | D14/306 |
| D493,843 | S | 8/2004 | Jackson et al. | D21/327 |
| D493,846 | S | 8/2004 | Seelig et al. | D21/370 |
| D495,754 | S | 9/2004 | Wurz et al. | D21/370 |
| D495,755 | S | 9/2004 | Wurz et al. | D21/370 |
| D500,098 | S | 12/2004 | Doi | D21/477 |
| 6,880,825 | B2 | 4/2005 | Seelig et al. | 273/143 R |
| 6,886,896 | B2 | 5/2005 | Hedrick et al. | 312/223.1 |
| D508,268 | S | 8/2005 | Hanchar et al. | D21/369 |
| D508,269 | S | 8/2005 | Wichinsky | D21/369 |
| D508,719 | S | 8/2005 | de Hass | D21/369 |
| D508,961 | S | 8/2005 | Gatto et al. | D21/369 |
| D509,254 | S | 9/2005 | Rasmussen et al. | D21/369 |
| D512,105 | S | 11/2005 | Chitrapongse et al. | D21/370 |
| D531,677 | S | 11/2006 | Mallory et al. | D21/369 |
| 7,184,277 | B2 | 2/2007 | Beirne | 361/807 |
| D539,854 | S | 4/2007 | Luciano et al. | D21/369 |
| 7,267,613 | B2 | 9/2007 | Cole | 463/20 |
| 7,309,284 | B2 | 12/2007 | Griswold et al. | 463/29 |
| D559,917 | S | 1/2008 | Cole | D21/369 |
| 7,322,653 | B2 | 1/2008 | Dragusin | 297/300.3 |
| D578,168 | S | 10/2008 | Looks et al. | D21/369 |
| 7,513,830 | B2 | 4/2009 | Hajder et al. | 463/46 |
| 7,611,408 | B2 | 11/2009 | Martin et al. | 463/29 |
| 7,641,554 | B2 | 1/2010 | Paulsen et al. | 463/42 |
| 2002/0041069 | A1 | 4/2002 | Steelman | 273/138.1 |
| 2003/0122973 | A1 | 7/2003 | Huang | 348/836 |
| 2004/0053662 | A1 | 3/2004 | Pacey | 463/16 |
| 2005/0014547 | A1 | 1/2005 | Gomez et al. | 463/16 |
| 2006/0079316 | A1 | 4/2006 | Flemming et al. | 463/25 |
| 2006/0131810 | A1 | 6/2006 | Nicely | 273/292 |
| 2006/0183553 | A1 | 8/2006 | Kiriyama et al. | 463/46 |
| 2006/0211484 | A1 | 9/2006 | Hornik et al. | 463/25 |
| 2006/0281559 | A1 | 12/2006 | Luciano | 463/46 |
| 2008/0234021 | A1* | 9/2008 | Palmer et al. | 463/2 |

FOREIGN PATENT DOCUMENTS

| | | |
|---|---|---|
| DE | 4339022 | 11/1993 |
| EP | 649 671 A1 | 4/1995 |
| JP | 03210172 B2 | 2/1993 |
| WO | WO 2008/024348 | 2/2008 |

OTHER PUBLICATIONS

Product Sheet for "Monopoly Chairman of the Board™", WMS Gaming Inc. 2 pages (1999).

Product Sheet for "American Eagle", Eagle Co., Ltd., 2 pages (2000).

Product Sheet for "Survivor", WMS Gaming Inc., 4 pages, (2001).

Product Sheet for "ProSLOT® 6000", Bally Gaming Systems, 4 pages, (2002).

Product Sheet for "EVO™ Hybrid", Bally Gaming Systems, 4 pages, (2002).

Product Sheet for "3RV™", WMS Gaming Inc., 2 pages, (2002 or earlier).

Product Sheet for "Miss America", AC Coin & Slot, 2 pages (2002 or earlier).

* cited by examiner

ADJUSTABLE PLAYING AREA FOR ELECTRONIC GAMING TERMINAL

CROSS-REFERENCE TO RELATED APPLICATIONS

This application claims the benefit of U.S. Provisional Application No. 61/112,967, filed Nov. 10, 2008, which is hereby incorporated-by-reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to a gaming apparatus, and methods for playing wagering games, and more particularly, to wagering games having adjustable playing areas.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

During extended play periods, players of gaming terminals tend to develop elaborate "work-arounds." For example, a player may slouch, cross his or her arms and/or legs, lean backwards, or reach for a button, all of which can force the player's body into counter-ergonomic positions. Additionally, in order to frequently depress certain buttons required to play the games, players end up with severely bent wrists and other uncomfortable work-around positions. What is needed is a gaming terminal that provides different gaming terminal configurations that add comfort and enjoyment to the player's gaming experience.

SUMMARY OF THE INVENTION

According to one aspect of the present disclosure, a gaming terminal includes a gaming cabinet, at least one display, an adjustable playing area, and a player-input button. The at least one display is mounted to the gaming cabinet and configured to display a randomly selected outcome from a wagering game. The randomly selected outcome is selected from a plurality of outcomes in response to receiving a wager input from a player. The adjustable playing area is mounted to the gaming cabinet below the at least one display. The adjustable playing area is operable to translate linearly between a proximal position and a distal position, the proximal position being near the gaming cabinet and the distal position being away from the gaming cabinet. The player-input button is mounted in the adjustable playing area for receiving game play input from the player.

According to another aspect of the disclosure, a gaming machine includes at least one display, an adjustable playing area, and a moveable player-input button. The at least one display is mounted to a gaming cabinet and configured to display a randomly selected outcome from a wagering game. The randomly selected outcome is selected from a plurality of outcomes in response to receiving a wager input from a player. The adjustable playing area includes a pad covering. The adjustable playing area is mounted to the gaming cabinet below the display and is operable to horizontally translate between a proximal position and a distal position, the proximal position being near the gaming cabinet and the distal position being away from the gaming cabinet. The moveable player-input button is mounted in the adjustable playing area for receiving game play input from the player. The moveable player-input button has a top surface generally flush with or below a top surface of the pad covering.

According to yet another aspect of the disclosure a gaming terminal includes an adjustable playing area and at least one display. The adjustable playing area is mounted to a gaming cabinet and is operable to translate linearly from a proximal position to one of a plurality of extended positions, the proximal position being near the gaming cabinet and each of the plurality of extended positions being away from the gaming cabinet. The at least one display is mounted to the gaming cabinet above the adjustable playing area and is configured to display a randomly selected outcome from a wagering game. The randomly selected outcome is selected from a plurality of outcomes in response to receiving a wager input from a player. The at least one display is configured to automatically adjust relative to a home position when the player manually adjusts the adjustable playing area.

According to another aspect of the disclosure a method of conducting a wagering game on a gaming terminal includes receiving a wager input from a player, allowing the player to select one or more player-selectable options for configuring the wagering game via one or more player-input devices, and translating an adjustable playing area in a linear direction from a proximal position toward a distal position. The proximal position is near a gaming cabinet of the gaming terminal and the distal position is farther from the gaming cabinet. The adjustable playing area has at least one player-input button distinct from the one or more player-input devices. The player-input button is fixed relative to the adjustable playing area.

According to yet another aspect of the disclosure a method of adjusting an adjustable playing area of a gaming machine, the adjustable playing area including a player-input button, includes receiving a wager input from a player. In response to receiving the wager input, the method further includes displaying a randomly selected outcome selected from a plurality of outcomes, activating a release button to disengage a locking mechanism, and sliding the adjustable playing area along a rail system from a proximal position to one of a plurality of extended positions. The proximal position is located near a gaming cabinet of the gaming machine and the extended positions is farther from the gaming cabinet. The method further includes automatically engaging the locking mechanism to secure the adjustable playing area at one of the plurality of extended positions, and automatically retracting the adjustable playing area to the proximal position after the occurrence of a predetermined event.

Additional aspects of the invention will be apparent to those of ordinary skill in the art in view of the detailed description of various embodiments, which is made with reference to the drawings, a brief description of which is provided below.

DETAILED DESCRIPTION

Figure 1:
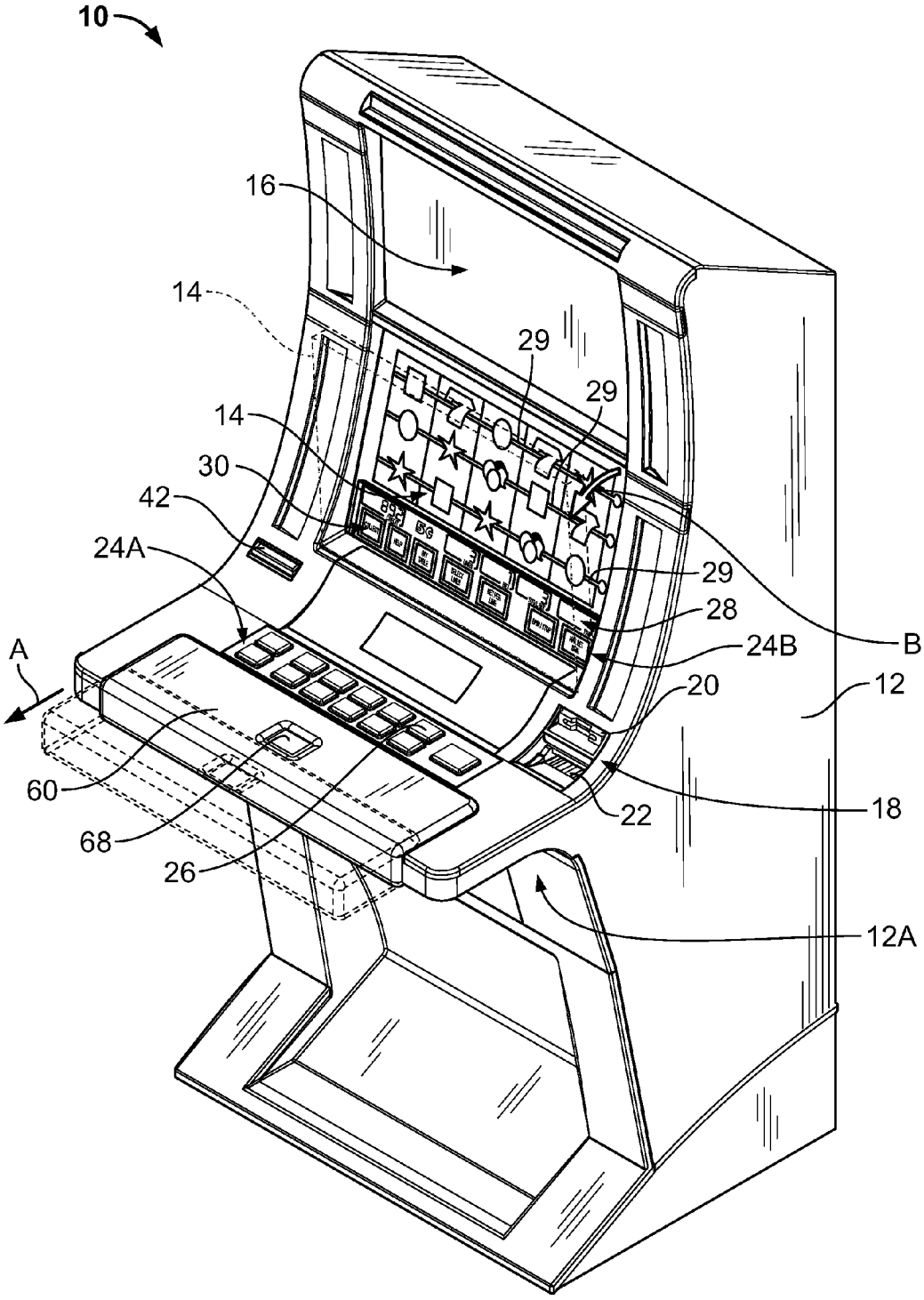
FIG. 1 is a perspective view of a free-standing gaming terminal according to some embodiments of the present disclosure.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1, a gaming terminal 10 is used in gaming establishments such as casinos. With regard to the present disclosure, the gaming terminal 10 may be any type of gaming terminal or machine and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, etc.

The gaming terminal 10 includes a gaming cabinet 12, a primary display 14, a secondary display 16, value input devices 18, player-input devices 24, and an adjustable playing area 60, although other numbers and types of devices and component arrangements are contemplated. The primary display 14 displays information about a basic wagering game. The primary display 14 can also display information about a bonus wagering game and a progressive wagering game. The primary display 14 is pivotally mounted in the gaming cabinet 12 such that the primary display 14 can tilt about a horizontal axis in the direction of arrow B, although the primary display 14 can be configured to rotate, translate, and/or slide in a variety of other directions and manners.

The secondary display 16 is fixedly mounted to the gaming cabinet 12, although other configurations for the secondary display 16 are contemplated. The primary display 14 and/or the secondary display 16 can be configured to display information associated with wagering games, non-wagering games, community games, progressives, advertisements, services, premium entertainment, text messaging, emails, alerts or announcements, broadcast information, subscription information, etc. A variety of other contemplated information may be displayed on the primary display 14 and/or on the secondary display 16.

While these typical components found in the gaming terminal 10 are described below, it should be understood that numerous other elements may exist and may be used in any number of combinations to create various forms of the gaming terminal 10.

The value input devices 18 may be provided in many forms, individually or in combination, and are preferably located on the front of the housing 12. The value input devices 18 receives currency and/or credits that are inserted by a player. The value input devices 18 may include a coin acceptor (not shown) for receiving coin currency. Alternatively, or in addition, the value input devices 18 may include a bill acceptor 22 for receiving paper currency. Furthermore, the value input devices 18 may include a card reader 20, a ticket reader, or barcode scanner used for account based wagering systems that read information stored on a credit ticket, a card, or other tangible portable credit storage device. The credit ticket or card may also authorize access to a central account, which can transfer money to the gaming terminal 10.

The player-input device 24A is fixedly mounted to a front extended ledge portion 12A of the gaming cabinet 12. The player-input device 24A includes a plurality of buttons 26 for operating the gaming terminal 10. The player-input-device 24A can include various other numbers and types of buttons, for example, two buttons, ten buttons, twenty buttons, etc. The buttons 26 are used in conjunction with items displayed on the primary display 14 and/or on the secondary display 16 to configure and/or play the wagering game on the gaming terminal 10. The buttons 26 can include a variety of buttons including, but not limited to, mechanical-type push buttons, programmable buttons with variable displays, touch-screen buttons, or combinations thereof.

In addition, or alternatively, the gaming terminal 10 includes the player-input device 24B, which comprises a touch screen 28 mounted by adhesive, tape, or the like over the primary display 14 and/or over the secondary display 16. The touch screen 28 contains soft touch keys 30 denoted by graphics on the underlying primary display 14 and used to operate the gaming terminal 10. The touch screen 28 provides players with an alternative method of input. A player enables a desired function either by touching the touch screen 28 at an appropriate soft touch key 30 or by pressing an appropriate button 26 on the button panel. The soft touch keys 30 may be used to implement the same functions as buttons 26. Alternatively, the buttons 26 may provide inputs for one aspect of the operating the game, while the soft touch keys 30 may allow for input needed for another aspect of the game.

The various components of the gaming terminal 10 may be connected directly to, or contained within, the housing 12, as seen in FIG. 1, or may be located outboard of the housing 12 and connected to the housing 12 via a variety of different wired or wireless connection methods. Thus, the gaming terminal 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming terminal 10. As shown, the primary display 14 includes the touch screen 28 overlaying the entire display (or a portion thereof) to allow players to make game-related selections. Alternatively, the primary display 14 of the gaming terminal 10 may include a number of mechanical reels to display the outcome in visual association with at least one payline 29.

A player begins play of the basic wagering game by making a wager via one or more of the value input devices 18 of the gaming terminal 10. A player can select play by using one of the player input devices 24, via the buttons 26 or the soft touch keys 30. The basic game consists of a plurality of symbols arranged in an array, and includes at least one payline 29 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

Figure 2:
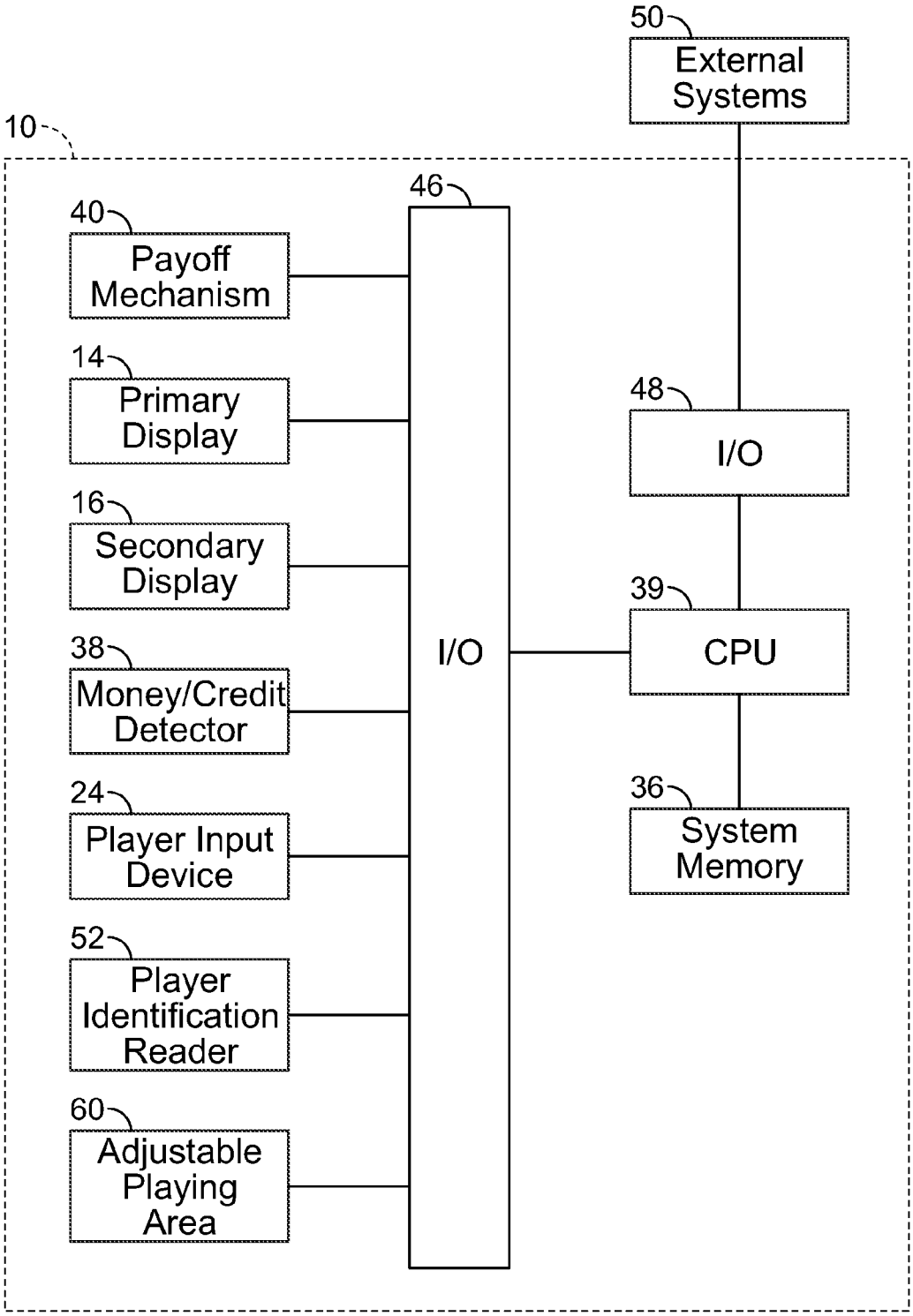
FIG. 2 is a schematic view of a gaming system according to some embodiments of the present disclosure.

Turning now to FIG. 2, the various components of the gaming terminal 10 are controlled by a central processing unit (CPU) 39, also referred to herein as a controller or processor (such as a microcontroller or microprocessor). To provide gaming functions, the controller 39 executes one or more game programs stored in a computer readable storage medium, in the form of system memory 36. The controller 39 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 39 may include one or more microprocessors, including but not limited to a master processor, a slave processor, and a secondary or parallel processor.

The controller 39 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via one or more of the value input devices 18. Preferably, these components are located within the housing 12 of the gaming terminal 10. However, as explained above, these components may be located outboard of the housing 12 and connected to the remainder of the components of the gaming terminal 10 via a variety of different wired or wireless connection methods.

As seen in FIG. 2, the controller 39 is also connected to, and controls, the primary display 14, the secondary display 16, the player input devices 24, a payoff mechanism 40, and the adjustable playing area 60. The payoff mechanism 40 is operable in response to instructions from the controller 39 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes a ticket printer 42. Alternatively or additionally, the payoff mechanism 40 can include a coin outlet (not shown). However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 39 and both the peripheral components of the gaming terminal 10 and external systems 50 occur through input/output (I/O) circuits 46, 48. More specifically, the controller 39 controls and receives inputs from the peripheral components of the gaming terminal 10 through the input/output circuits 46. Further, the controller 39 communicates with the external systems 50 via the I/O circuits 48 and a communication path (e.g., serial, parallel, IR, RC, 10bT, etc.). The external systems 50 may include a gaming network, other gaming terminals, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

According to some embodiments, the controller 39 is coupled to the adjustable playing area 60 and/or a player-input button 68. The controller 39 can also communicate and/or control adjustable aspects of the adjustable playing area 60 and/or operational aspects of the player-input button 68. For example, the controller 39 can automatically adjust the adjustable playing area 60 upon the occurrence of a gaming event and/or a predetermined event. For another example, the controller 39 can switch the player-input button 68 on and off according to certain aspects. Further details regarding the adjustable playing area 60 and the player-input button 68 are provided below in reference to FIGS. 3A-4B.

The controller 39, as used herein, comprises any combination of hardware, software, and/or firmware that may be disposed or resident inside and/or outside of the gaming terminal 10 that may communicate with and/or control the transfer of data between the gaming terminal 10 and a bus, another computer, processor, or device and/or a service and/or a network. The controller 39 may comprise one or more controllers or processors. In FIG. 2, the controller 39 in the gaming terminal 10 is depicted as comprising a CPU, but the controller 39 may alternatively comprise a CPU in combination with other components, such as the I/O circuits 46, 48 and the system memory 36. The controller 39 may reside partially or entirely inside or outside of the gaming terminal 10.

The gaming terminal 10 may communicate with external systems 50 (in a wired or wireless manner) such that each terminal operates as a "thin client," having relatively less functionality, a "thick client," having relatively more functionality, or through any range of functionality therebetween (e.g., a "rich client"). As a generally "thin client," the gaming terminal may operate primarily as a display device to display the results of gaming outcomes processed externally, for example, on a server as part of the external systems 50. In this "thin client" configuration, the server executes game code and determines game outcomes (e.g., with a random number generator), while the controller 39 on board the gaming terminal processes display information to be displayed on the display (s) of the gaming terminal. In an alternative "rich client" configuration, the server determines game outcomes, while the controller 39 on board the gaming terminal executes game code and processes display information to be displayed on the display(s) of the gaming terminal. In yet another alternative "thick client" configuration, the controller 39 on board the gaming terminal executes game code, determines game outcomes, and processes display information to be displayed on the display(s) of the gaming terminal. Numerous alternative configurations are possible such that the aforementioned and other functions may be performed onboard or external to the gaming terminal 10 as may be necessary for particular applications.

According to some embodiments, the controller 39 is also connected to, and controls, a player identification reader 52. The player identification reader 52 allows for identification of a player by reading a card with information indicating his or her true identity. The player identification reader 52 can be the same device as the card reader 20 or a separate device (not shown). The player identification reader 52 can be a card reader, a ticket reader, a bar code scanner, an RFID transceiver, or a computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player identification reader 52, which allows the casino's computers to register that player's wagering at the gaming terminal 10. The gaming terminal 10 may use the secondary display 16 or other dedicated player-tracking display for providing the player with information about his or her account or other player-specific information. Also, in some embodiments, the player identification reader 52 may be used to restore game assets that the player achieved and saved during a previous game session.

Security features are advantageously utilized where the gaming terminal 10 communicate wirelessly with external systems 50, such as through wireless local area network (WLAN) technologies, wireless personal area networks (WPAN) technologies, wireless metropolitan area network (WMAN) technologies, wireless wide area network (WWAN) technologies, or other wireless network technologies implemented in accord with related standards or protocols (e.g., the Institute of Electrical and Electronics Engineers (IEEE) 802.11 family of WLAN standards, IEEE 802.11i, IEEE 802.11r (under development), IEEE 802.11w (under development), IEEE 802.15.1 (Bluetooth), IEEE 802.12.3, etc.). For example, a WLAN in accordance with some embodiments comprises a robust security network (RSN), a wireless security network that allows the creation of robust security network associations (RSNA) using one or more cryptographic techniques, which provides one system to avoid security vulnerabilities associated with IEEE 802.11 (the Wired Equivalent Privacy (WEP) protocol). Constituent components of the RSN may comprise, for example, stations (STA) (e.g., wireless endpoint devices such as laptops, wireless handheld devices, cellular phones, handheld gaming terminal 110, etc.), access points (AP) (e.g., a network device or devices that allow(s) an STA to communicate wirelessly and to connect to another network, such as a communication device associated with I/O circuit(s) 48), and authentication servers (AS) (e.g., an external system 50), which provide authentication services to STAs. Information regarding security features for wireless networks may be found, for example, in the National Institute of Standards and Technology (NIST), Technology Administration U.S. Department of Commerce, Special Publication (SP) 800-97, Establishing Wireless Robust Security Networks: A Guide to IEEE 802.11, and SP 800-48, Wireless Network Security: 802.11, Bluetooth and Handheld Devices, both of which are incorporated herein by reference in their entirety.

Figure 3A:
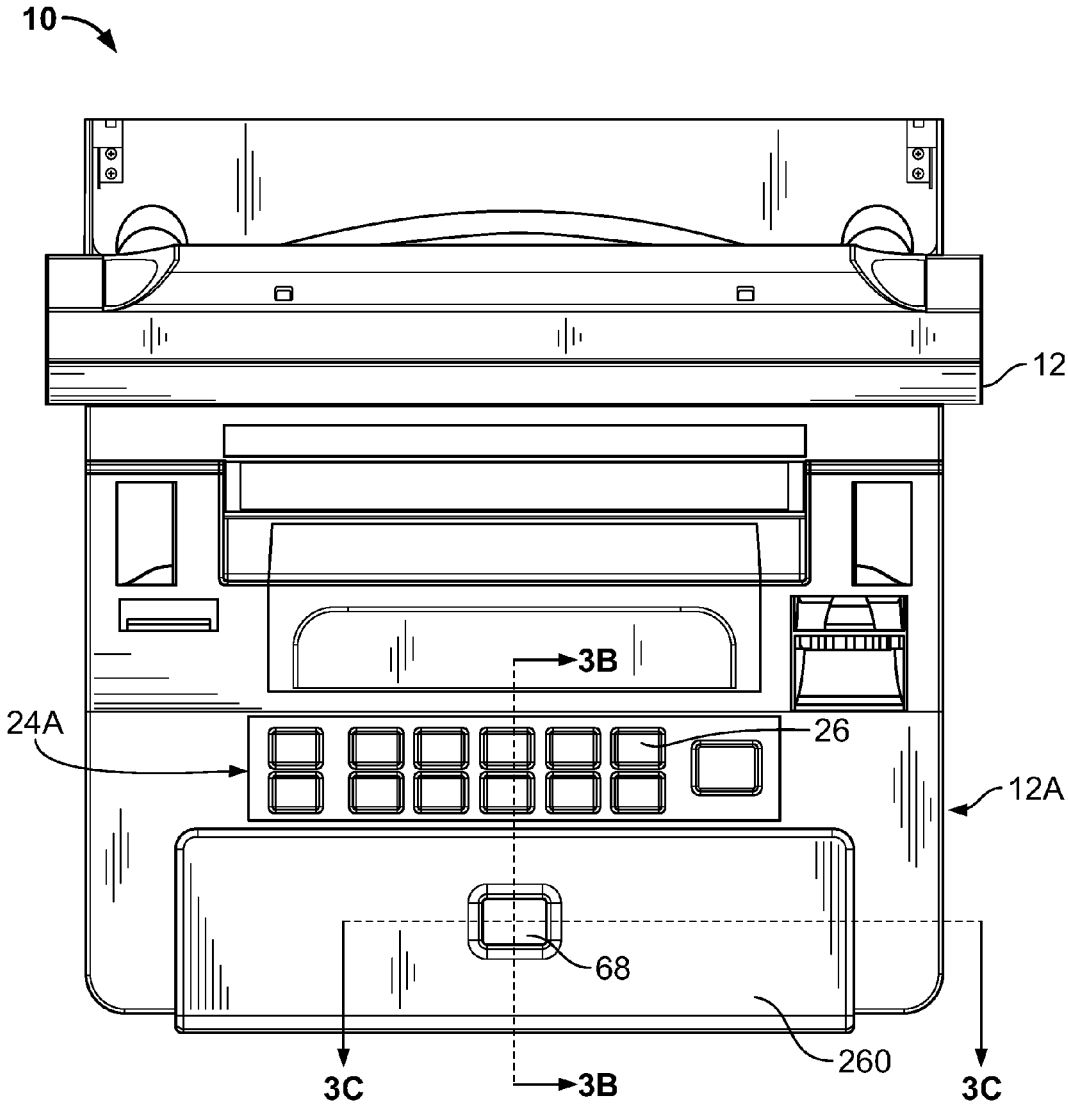
FIG. 3A is a top view of the free-standing gaming terminal of FIG. 1.
Figure 3B:
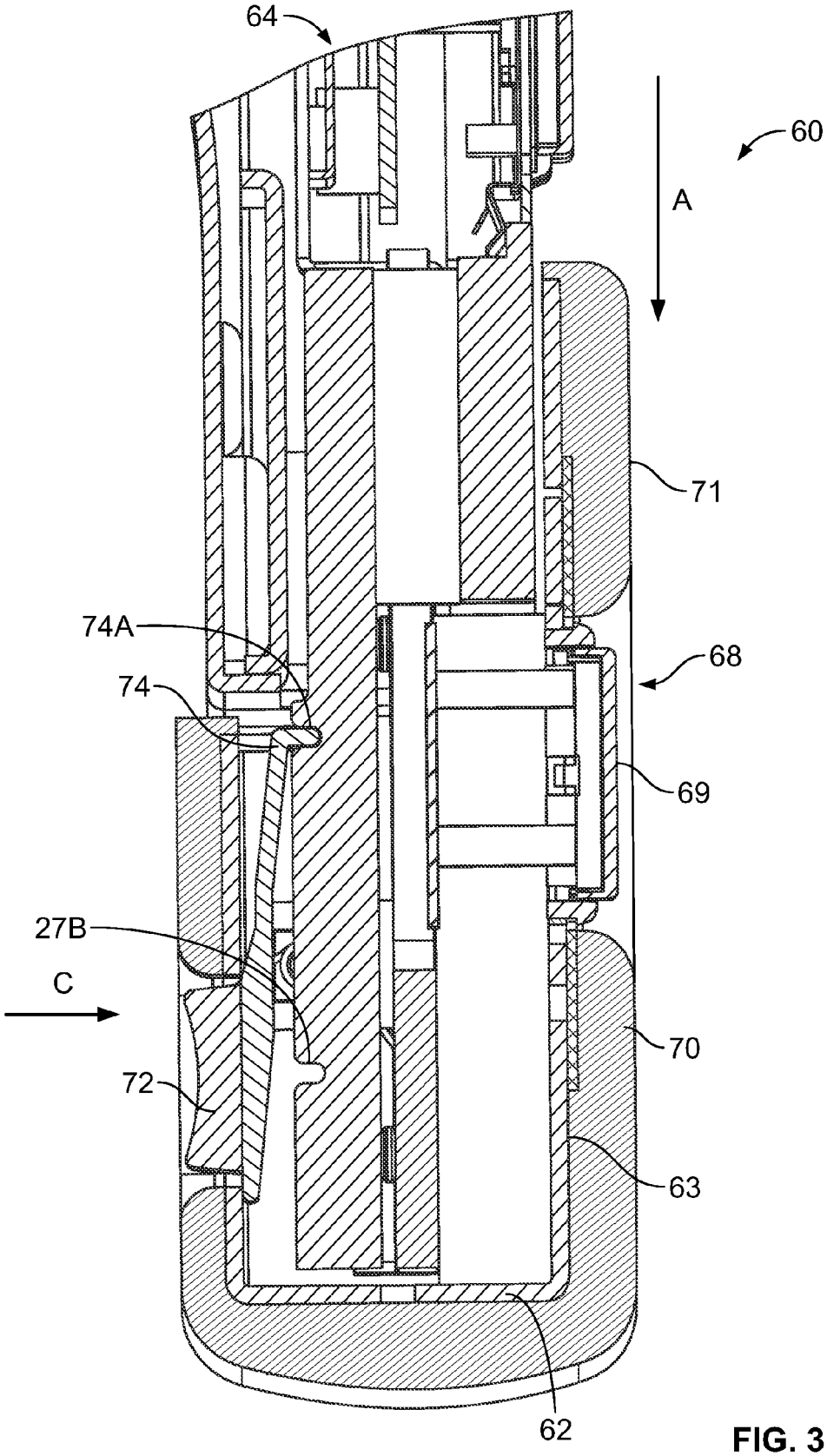
FIG. 3B is a side cross-sectional view of a front portion of the free-standing gaming terminal of FIG. 1.
Figure 3C:
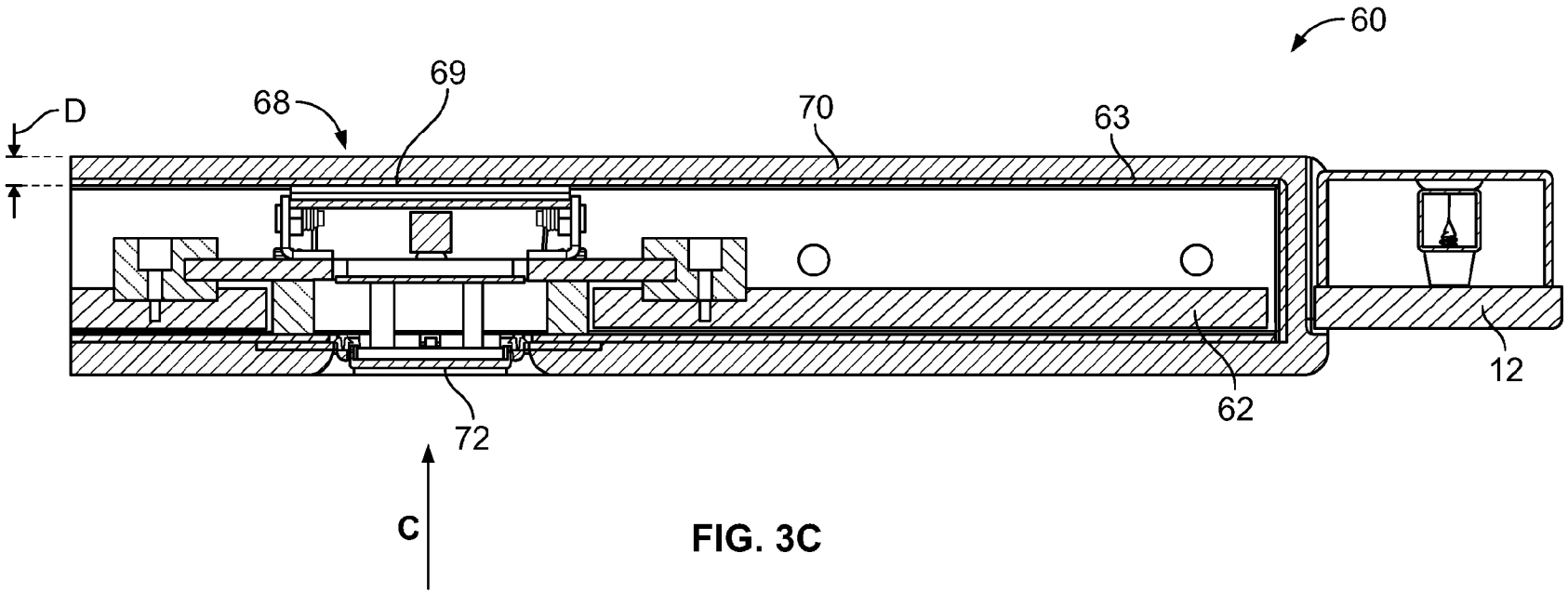
FIG. 3C is a front cross-sectional view of the front portion of the free-standing gaming terminal of FIG. 1.

Referring to FIGS. 3A-3C, the adjustable playing area 60 of the gaming terminal 10 includes a main body 62, a rail system 64, the player-input button 68, a pad covering 70, a release button 72, and a locking mechanism 74, although other numbers and types of component configurations are contemplated. The adjustable playing area 60 may also be referred to as an adjustable playing surface, an adjustable playing device, or an adjustable armrest.

The main body 62 has an outer surface 63 that is coupled with the pad covering 70. The main body 62 can be formed from any rigid material including, but not limited to, plastic, metal, or a combination thereof. The pad covering 70 is also referred to as a soft pad covering that is formed from a cushion-type material. The cushion-type material provides a comfortable area for a player to rest an arm, wrist, hand, and/or elbow while repeatedly playing the wagering game. The cushion-type material can be a variety of materials including, but not limited to, foam, polyurethane foam, gel, plastic, cotton, fabric, down-feathers, etc., although other materials with more or less cushioning properties are contemplated. The pad covering 70 can include a cover (not shown) to protect the pad covering 70 from dirt and wear and tear common in a casino environment.

The rail system 64 is coupled to the main body 62 and to the gaming cabinet 12 such that the main body 62 can slide back and forth along the rail system 64 relative to the gaming cabinet 12. The rail system 64 may include a variety of components including tracks, guide rails, bearings, and wheels, although other numbers and types of components are contemplated.

Figure 4A:
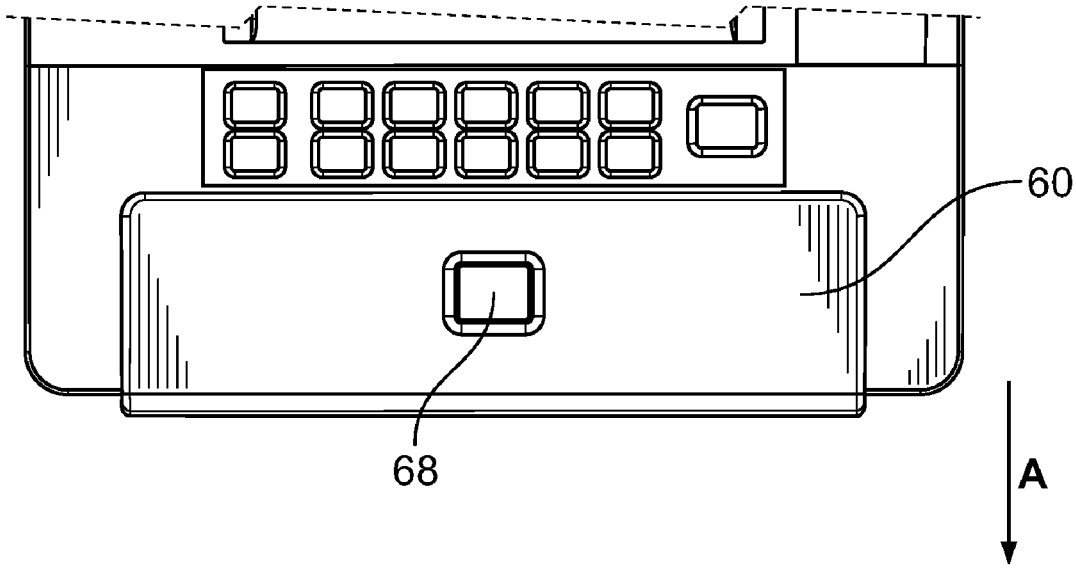
FIG. 4A illustrates an adjustable playing area of the free-standing gaming terminal of FIG. 1 in a first position.
Figure 4B:
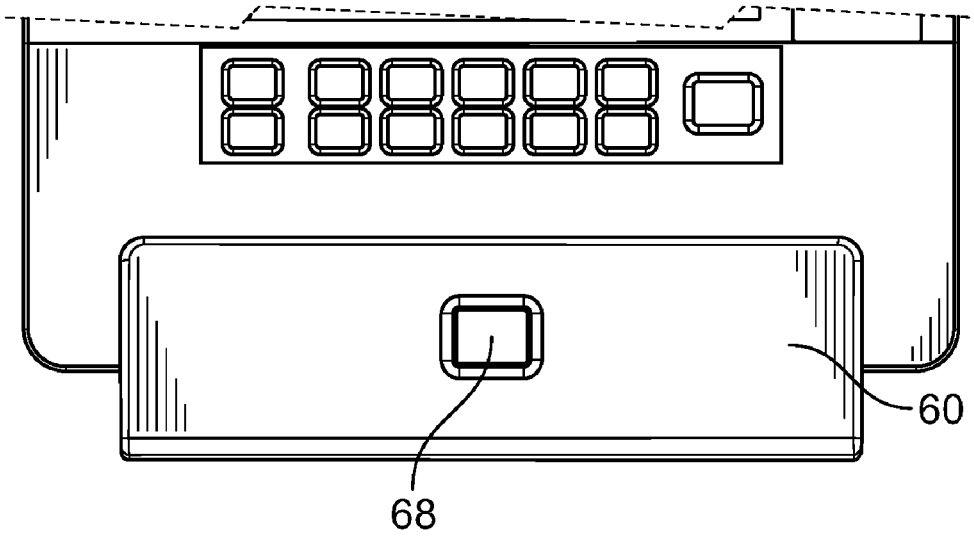
FIG. 4B illustrates the adjustable playing area of FIG. 4A in a second position.

The rail system 64 moveably attaches the adjustable playing area 60 to the front extended ledge portion 12A of the gaming cabinet 12 below the primary display 14. Referring to FIGS. 4A-4B, the player of the gaming terminal 410 can adjust a position of the adjustable playing area 60 between a plurality of positions. The player can linearly translate the adjustable playing area 60 in the direction of arrow A, although the adjustable playing area 60 can be adjusted in a variety of other directions and manners. For example, the adjustable playing area 60 can be rotated and/or translated upward, downward, or any combination thereof.

The adjustable playing area 60 has a proximal position (FIG. 4A), which is near or closest to the gaming cabinet 12 and a distal position (FIG. 4B), which is furthest away from the gaming cabinet 12. While only the proximal position and the distal position of the adjustable playing area 60 are shown, a plurality of extended intermediate positions of the adjustable playing area 60 are contemplated. For example, a player can adjust the position of the adjustable playing area 60 to any one of a plurality of intermediate positions, where the adjustable playing area 60 is spaced further away from the gaming cabinet 12 than in the proximal position, yet closer than when the adjustable playing area 60 is in the distal position.

Referring back to FIGS. 3B-3C, the player-input button 68 is mounted within the adjustable playing area 60 to the main body 62 such that a top surface 69 of the player-input button 68 is below a top surface 71 of the pad covering 70. Put another way, the player-input button 68 is mounted sub-flush with respect to the top surface 71 of the pad covering 70. Alternatively, the player-input button 68 can be mounted within the adjustable playing area 60 to the main body 62 such that the top surface 69 of the player-input button 68 is flush with respect to the top surface 71 of the pad covering 70. Thus, the player-input button 68 is effectively embedded within the pad covering 70. While only one player-input button 68 is shown, the adjustable playing area 60 can include other numbers and types of buttons, such as, for example, a first button positioned for right-handed players and a second button positioned for left-handed players.

The player-input button 68 can also be referred to as a moveable player-input button and/or a play button (e.g., a spin button for a slot game, a deal/draw button for a poker game, etc.). For example, the moveable player-input button can be a spring-biased push-button that vertically moves relative to the main body 62 in response to being pressed by the player. Use of such a moveable player-input button can help reduce inadvertent actuation by the player using the gaming terminal 10. Alternatively, the moveable player-input button is not a push-button that moves relative to the main body 62, but rather a miniature touch-screen-button that senses the player's finger. In these embodiments, the moveable player-input button is moveable with the adjustable playing area 60 as the adjustable playing area 60 is translated.

The player-input button 68 can be a programmable button configured to display content associated with the wagering game. For example, the player-input button 68 can be programmed to display coins or money when a winning outcome is displayed on the primary display 14 and/or on the secondary display 16. In another example, the player-input button 68 can be programmed to display advertisements related or unrelated to the wagering gaming being played on the gaming terminal 10. Other examples and description of programmable player-input buttons can be found in commonly assigned PCT Patent Application No. PCT/US2007/018488, entitled "System for Processing Input in a Wagering Game Machine" and PCT Patent Application No. PCT/US2007/017711, entitled "Peripheral Device Control System for Wagering Game Systems," both of which are hereby incorporated herein by reference in their entireties.

The release button 72 is positioned on a bottom side of the adjustable playing area 60. The release button 72 is mechanically coupled to the locking mechanism 74. The locking mechanism 74 has a locked position or secured position (shown in FIG. 3B) and an unlocked position or unsecured position. The player can unlock the locking mechanism 74 by pressing the release button 72 in the direction of arrow C, thereby disengaging the locking mechanism 74 from a first notch 74*a*. After the locking mechanism 74 is disengaged from the first notch 74*a*, the player can manually translate the adjustable playing area 60 in the direction of arrow A.

The locking mechanism 74 is spring loaded, which biases the locking mechanism 74 in the locked position when the player releases the release button 72. As the player manually translates the adjustable playing area 60 in the direction of arrow A, the locking mechanism 74 glides along a portion of the main body 62 until the locking mechanism 74 engages a second notch 74*b*. If the player has released the release button 72, the locking mechanism 74 will engage the second notch 74*b*, thereby locking the adjustable playing area 60 in the distal position, although the locking mechanism 74 can engage a number of other notches (not shown) to lock the adjustable playing area 60 in one of the plurality of extended positions.

While the release button 72 and the locking mechanism 74 are shown and described according to some embodiments, it is contemplated that the release button 72 and the locking mechanism 74 can be positioned in a variety of other locations. For example, the release button 72 and the locking mechanism 74 can be positioned on a side surface or a top surface of the adjustable playing area 60. For another example, the release button 72 and the locking mechanism 74 can be positioned anywhere on or in the gaming cabinet 12. It is also contemplated that the release button 72 and the locking mechanism 74 are controlled by the controller 39 and/or by the player. For example, the player can press one or more position buttons to automatically adjust the position of the adjustable playing area 60.

For another example, the gaming terminal 10 further includes a mechanical mechanism (not shown) configured to automatically retract the adjustable playing area 60 along the rail system 64 from an extended position to the proximal position. The mechanical mechanism is coupled between the gaming cabinet 12 and the adjustable playing area 60 and operatively coupled to the controller 39. The mechanical mechanism can be one or more of a solenoid, a piston, and a motor, although other types of devices can be used to automatically retract the adjustable playing area 60. The mechanical mechanism is configured to retract the adjustable playing area 60 to the proximal position after the gaming terminal is idle for a predetermined period of time, for example, two minutes. In these embodiments, the controller 39 unlocks the locking mechanism 74 prior to automatically retracting the adjustable playing area 60. Alternatively or additionally, the mechanical mechanism can be configured to retract the adjustable playing area 60 to the proximal position after the occurrence of a gaming event. Examples of gaming events include, but are not limited to, a base or bonus game winning outcome, a start bonus game outcome, a progressive winning outcome, a losing outcome, and a loss of all credits.

According to some embodiments, the adjustable playing area 60 further includes a mechanical dampener to smooth the movements of the adjustable playing area 60 along the rail system 64. It is contemplated that the dampener can include a spring or a low-durometer elastomeric bumper. Alternatively or additionally, the mechanical dampener can include a spring or friction bearing attached to an idle gear that is coupled with a geared rack. The geared rack can be attached the rail system 64 such that the idle gear acts to dampen movement of the adjustable playing area 60.

According to some embodiments, the gaming terminal 10 further includes a switch operatively coupled to the player-input button 68. The switch is configured to deactivate the player-input button 68 when the adjustable playing area 60 is in the proximal position to reduce inadvertent activation of the player-input button 68. Similarly, the switch is configured to activate the player-input button 68 when the adjustable playing area 60 is in the distal position or any one of the plurality of extended positions.

Referring back to FIG. 1, the primary display 14 has a home position and an adjusted or extended position. The primary display 14 can be configured to automatically adjust relative to the home position when the player adjusts the adjustable playing area 60. For example, if a player adjusts the adjustable playing area 60 from the proximal position to the distal position, then the primary display 14 automatically adjusts from the home position. The primary display 14 automatically adjusts by rotating in the direction of arrow B to provide a different viewing angle to the player, although the primary display 14 can automatically adjust in a variety of other directions and manners, such as, for example, translating up, down, in, and/or out. The primary display 14 can also be configured to return or retract to the home position upon the occurrence of a gaming event. Such gaming events include, but are not limited to, a player adjusting the adjustable playing area 60 to the proximal position, passing of a predetermined period of time, a losing outcome, and a winning outcome.

Referring generally to FIGS. 1, 2, 3A-3C, and 4A-4B, an exemplary cycle of operation will be described according to some embodiments. A player inserts credits and/or money into one or more of the value input devices 18 to play a wagering game. The gaming terminal 10 allows the player to establish a wager configuration with one or more player-selectable options, which are displayed on the primary display 14. The player selects one or more of the player-selectable options using the soft touch keys 30 on the touch screen 28 and/or the buttons 26 to configure the wagering game. The player-selectable options for establishing the wager configuration include one or more of a payline selection and a wager selection. The player selects a payline option and indicates how many credits to wager-per-payline, although the player can forego the wager configuration process and play the wagering game according to a default wager configuration. The default configuration can entail a wagering game where all paylines are active with a one or more credit wager-per-payline, although other default configurations are contemplated, such as, for example, one active payline with a one credit wager-per-payline.

After the wagering game is configured and the player inserts money and/or credits, the player presses one of the plurality of buttons 26, typically called a play button, to initiate a first play of the wagering game. The controller 39 displays a first randomly selected outcome from the wagering game on the primary display 14. The randomly selected outcome is selected by the controller 39 from a plurality of possible outcomes. The randomly selected outcome is selected at least in part in accordance with the wager configuration selections made by the player. That is, the outcome is based at least in part on the player's payline selection and wager-per-payline. Once the player configures the wagering game, the player's selections are stored and/or saved into a memory (e.g., memory 36) such that the player can continue playing the wagering game without having to reconfigure the gaming terminal 10 after each play or spin of the wagering game.

To increase comfort and/or enjoyment of the wagering game, the player adjusts the position of the adjustable playing area 60. Initially, the player engages the release button 72 by pressing the release button 72 in the direction of arrow C. The locking mechanism 74 is moved into the unlocked position. The player then translates, along a linear direction in the direction of arrow A, the adjustable playing area 60 to one of the plurality of extended and/or adjusted positions. The player releases the release button 72 and the locking mechanism 74 engages a notch (e.g., the second notch 74*b*), thereby locking the adjustable playing area 60 into an extended position (e.g., the distal position). After the adjustable playing area 60 is moved into the extended position, the player-input button 68 is automatically activated via the switch. According to some embodiments, after the adjustable playing area 60 is locked into the extended position, the primary display 14 automatically rotates in the direction of arrow B to change the player's viewing angle.

The player continues to play the wagering game according to the wager configuration selections by actuating the player-input button 68 or by pressing one of the buttons 26. Actuating the player-input button 68, also known as a play button, causes the controller 39 to register the player's bet according to the wager configuration and to display a subsequent randomly selected outcome on the primary display 14. The subsequent randomly selected outcome is selected by the controller 39 from a plurality of possible outcomes in response to the activation of the player-input button 68. Additionally, the subsequent randomly selected outcome is selected in accordance with input received solely from the player-input button 68. Thus, the subsequent randomly selected outcome is based on the same wager configuration selections made by the player. That is, the subsequent randomly selected outcome is based at least in part on the player's previously made payline selection and wager-per-payline.

According to some embodiments, the player can change the configuration selections after any wagering game is completed. Thus, the player can adjust a number of active paylines and/or the wager-per-payline. According to other embodiments, after the player is finished playing the wagering game and the gaming terminal 10 is left idle for a predetermined amount of time, the adjustable playing area 60 is automatically retracted to the proximal position and the primary display 14 is automatically retracted to the home position. According to yet other embodiments, after the player loses all of his or her credits and fails to input additional credits, the adjustable playing area 60 is automatically retracted to the proximal position and the primary display 14 is automatically retracted to the home position.

Each of these embodiments and obvious variations thereof is contemplated as falling within the spirit and scope of the claimed invention, which is set forth in the following claims.

What is claimed is:

1. A gaming terminal comprising:

a gaming cabinet;

at least one display mounted to the gaming cabinet and being configured to display a randomly selected outcome from a wagering game, the randomly selected outcome being selected from a plurality of outcomes in response to receiving a wager input from a player;

an adjustable playing area mounted to the gaming cabinet below the at least one display, the adjustable playing area being operable to translate linearly between a proximal position and a distal position, the proximal position being near the gaming cabinet and the distal position being away from the gaming cabinet; and a player-input button mounted in the adjustable playing area for receiving game play input from the player.

2. The gaming terminal of claim 1, wherein the player-input button is one or more of a play button, a programmable button configured to display content associated with the wagering game, or any combination thereof.

3. The gaming terminal of claim 1, further comprising one or more additional player-input buttons mounted in the adjustable playing area.

4. The gaming terminal of claim 1, further comprising a switch operatively coupled to the adjustable playing area, the switch deactivating the player-input button when the adjustable playing area is in the proximal position.

5. The gaming terminal of claim 1, wherein the adjustable playing area has a plurality of extended positions located between the proximal position and the distal position.

6. The gaming terminal of claim 5, further comprising a mechanical mechanism configured to automatically retract the adjustable playing area from one of the plurality of extended positions to the proximal position after the gaming machine is idle for a predetermined period of time.

7. The gaming terminal of claim 6, further comprising a mechanical damper coupled to the adjustable playing area.

8. The gaming terminal of claim 1, further comprising a rail system mounted to the adjustable playing area and to the gaming cabinet for facilitating the linear translation of the adjustable playing area.

9. The gaming terminal of claim 8, wherein the adjustable playing area includes a release button for releasing the adjustable playing area from a secured position.

10. The gaming terminal of claim 8, further comprising a soft pad covering that surrounds at least a portion of an outer surface of the adjustable playing area.

11. The gaming terminal of claim 10, wherein the player-input button is positioned such that a top surface of the player-input button is generally flush with a top surface of the pad covering.

12. The gaming terminal of claim 10, wherein the player-input button is positioned such that a top surface of the player-input button is generally below a top surface of the pad covering.

13. A gaming machine comprising:

at least one display mounted to a gaming cabinet and being configured to display a randomly selected outcome from a wagering game, the randomly selected outcome being selected from a plurality of outcomes in response to receiving a wager input from a player;

an adjustable playing area having a pad covering, the adjustable playing area being mounted to the gaming cabinet below the display, the adjustable playing area being operable to horizontally translate between a proximal position and a distal position, the proximal position being near the gaming cabinet and the distal position being away from the gaming cabinet; and a moveable player-input button mounted in the adjustable playing area for receiving game play input from the player, the moveable player-input button having a top surface generally flush with or below a top surface of the pad covering.

14. The gaming machine of claim 13, further comprising a switch operatively coupled to the adjustable playing area, the switch deactivating the moveable player-input button when the adjustable playing area is in the proximal position.

15. The gaming machine of claim 13, wherein the adjustable playing area includes a main body and a rail system, the rail system being mounted to the main body and to the gaming cabinet, the moveable player-input being mounted in the main body of the adjustable playing area.

16. The gaming machine of claim 15, further comprising a mechanical mechanism coupled to the main body, the mechanical mechanism configured to automatically retract the adjustable playing area from one of a plurality of extended positions to the proximal position after the occurrence of a gaming event.

17. A gaming terminal comprising:

an adjustable playing area mounted to a gaming cabinet, the adjustable playing area being operable to translate linearly from a proximal position to one of a plurality of extended positions, the proximal position being near the gaming cabinet and each of the plurality of extended positions being away from the gaming cabinet; and at least one display mounted to the gaming cabinet above the adjustable playing area and being configured to display a randomly selected outcome from a wagering game, the randomly selected outcome being selected from a plurality of outcomes in response to receiving a wager input from a player, the at least one display being configured to automatically adjust relative to a home position when the player manually adjusts the adjustable playing area.

18. The gaming terminal of claim 17, wherein the at least one display is configured to automatically return to the home position upon the occurrence of a gaming event.

19. The gaming terminal of claim 17, wherein automatic adjustment of the display includes one or more of a rotational adjustment and a translational adjustment.

20. The gaming terminal of claim 17, wherein the at least one display is configured to tilt to adjust a viewing angle.

21. A method of conducting a wagering game on a gaming terminal, the method comprising:

receiving a wager input from a player;

allowing the player to select one or more player-selectable options for configuring the wagering game via one or more player-input devices;

translating an adjustable playing area in a linear direction from a proximal position toward a distal position, the proximal position being near a gaming cabinet of the gaming terminal and the distal position being farther from the gaming cabinet, the adjustable playing area having at least one player-input button distinct from the one or more player-input devices, the player-input button being fixed relative to the adjustable playing area.

22. The method of claim 21, wherein the player-selectable options include one or more of a payline selection and a wager selection.

23. The method of claim 21, further comprising:

displaying an initial randomly selected outcome in accordance with selections made via the one or more player-input devices;

actuating the at least one player-input button to provide game play input; and in response to the actuating, displaying a subsequent randomly selected outcome in accordance with input received solely from the at least one player-input button.

24. The method of claim 23, wherein the subsequent randomly selected outcome is based on the same selections made via the one or more player-input devices.

25. A method of adjusting an adjustable playing area of a gaming machine, the adjustable playing area including a player-input button, the method comprising:

receiving a wager input from a player;

in response to receiving the wager input, displaying a randomly selected outcome selected from a plurality of outcomes;

activating a release button to disengage a locking mechanism;

sliding the adjustable playing area along a rail system from a proximal position to one of a plurality of extended positions, the proximal position being located near a gaming cabinet of the gaming machine and the extended positions being farther from the gaming cabinet;

automatically engaging the locking mechanism to secure the adjustable playing area at one of the plurality of extended positions; and automatically retracting the adjustable playing area to the proximal position after the occurrence of a predetermined event.

26. The method of claim 25, further comprising automatically deactivating the player-input button when the adjustable playing area is in the proximal position.

* * * * *